US006047584A

United States Patent [19]

Filippo

[11] Patent Number: 6,047,584

[45] Date of Patent: Apr. 11, 2000

[54] MULTIPURPOSE HEAD FORMING AND FINISHING APPARATUS

[76] Inventor: Amadio Filippo, Via Colle Cervinara 5, Folignano, Italy

[21] Appl. No.: 08/952,745

[22] PCT Filed: May 10, 1996

[86] PCT No.: PCT/IB96/00442

§ 371 Date: Nov. 7, 1997

§ 102(e) Date: Nov. 7, 1997

[87] PCT Pub. No.: WO96/35528

PCT Pub. Date: Nov. 14, 1996

[30] Foreign Application Priority Data

May 12, 1995 [IT] Italy ..... B095A0023

[51] Int. Cl.[7] ..... B21D 19/00

[52] U.S. Cl. ..... 72/116; 72/125; 72/318

[58] Field of Search ..... 72/116, 117, 125, 72/316, 317, 318, 357

[56] References Cited

U.S. PATENT DOCUMENTS

| | | | |
|---|---|---|---|
| 2,124,743 | 7/1938 | McMahon | 72/117 |
| 2,241,091 | 5/1941 | Hood | 72/357 |
| 2,426,723 | 9/1947 | Barrett | 280/46 |
| 3,041,899 | 7/1962 | Benninghoff | 72/357 |
| 3,411,338 | 11/1968 | Carlin . | |
| 3,610,016 | 10/1971 | Bultman . | |
| 4,526,023 | 7/1985 | Babb | 72/125 |
| 5,104,031 | 4/1992 | Wolfe | 72/125 |

FOREIGN PATENT DOCUMENTS

| | | | |
|---|---|---|---|
| 780095 | 3/1968 | Canada | 72/318 |
| 2 135 100 | 12/1972 | France . | |
| 2 451 235 | 10/1980 | France . | |
| 2 692 291 | 12/1993 | France . | |
| 634 760 | 2/1983 | Switzerland . | |
| 11109 | 7/1895 | United Kingdom | 72/318 |
| 2 175 831 | 12/1986 | United Kingdom . | |
| 2 203 976 | 11/1988 | United Kingdom . | |

*Primary Examiner*—Lowell A. Larson
*Attorney, Agent, or Firm*—Nims, Howes, Collison Hansen & Lackert

[57] ABSTRACT

A multipurpose head forming and finishing apparatus includes a support frame (3) forming, on a horizontal plane, an arc holding a pair of arms (3*a*, 3*b*) symmetrical with respect to a median vertical plane. The frame (3) has a clamp (4), operated in a horizontal direction, for gripping a pipe (2) in proximity of a head (2*a*) to be worked. The clamp (4) includes a stationary jaw (5) and a mobile jaw (6), slidably supported on the arms (3*a*, 3*b*) of the support frame (3) by respective coupling guides and members, the jaws closable on the median symmetry plane. A tool (26) is operated in a direction axial with respect to the pipe (2) held by the clamp (4).

16 Claims, 8 Drawing Sheets

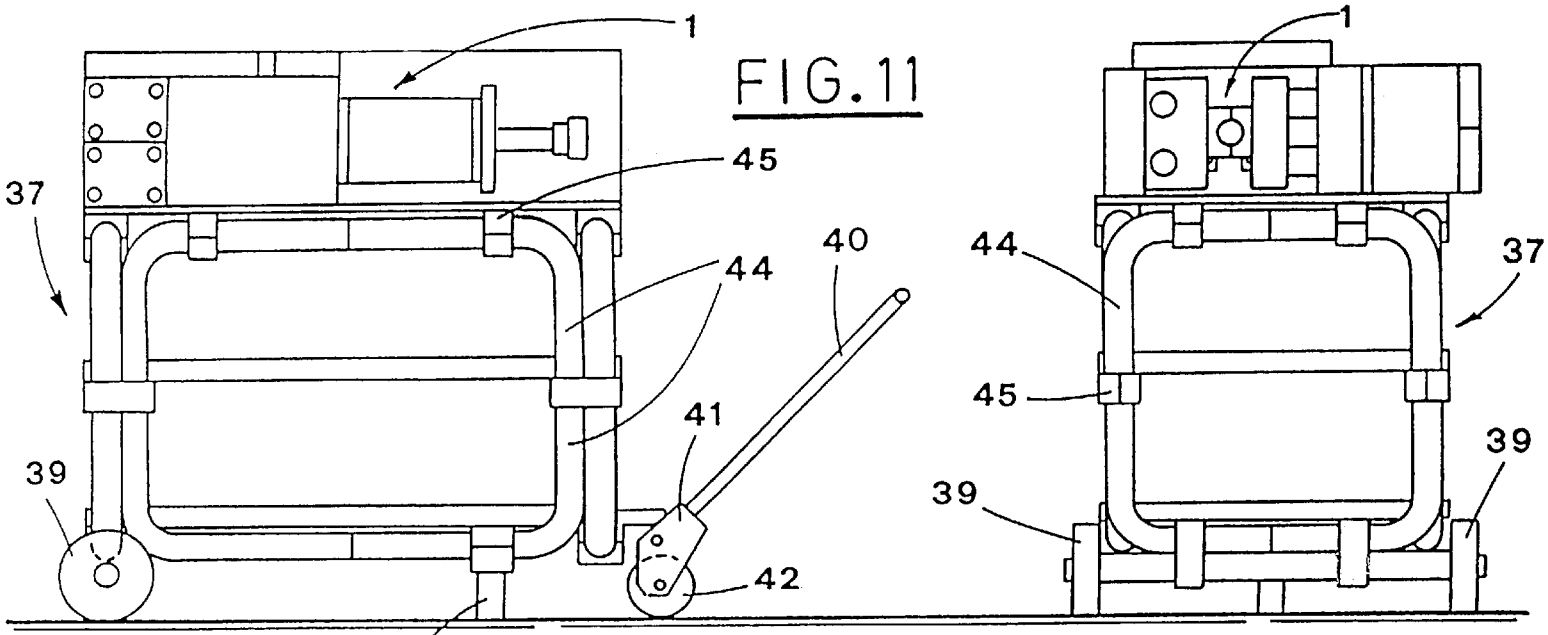
FIG. 12
FIG. 11
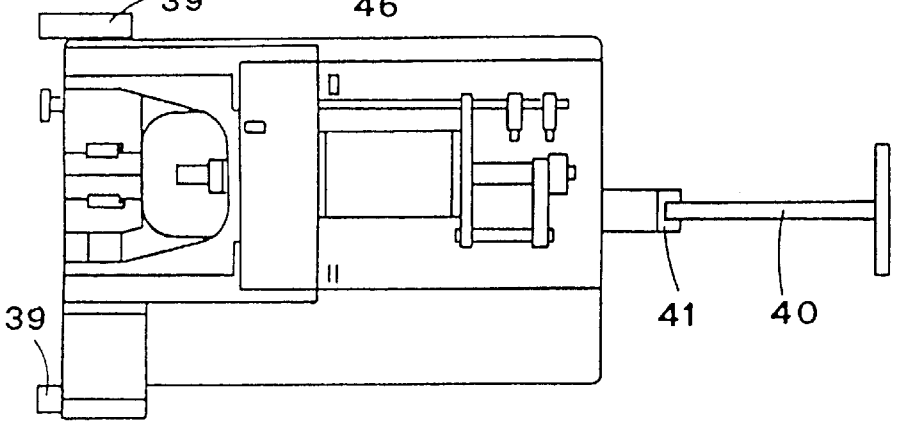
FIG. 13

FIG. 14
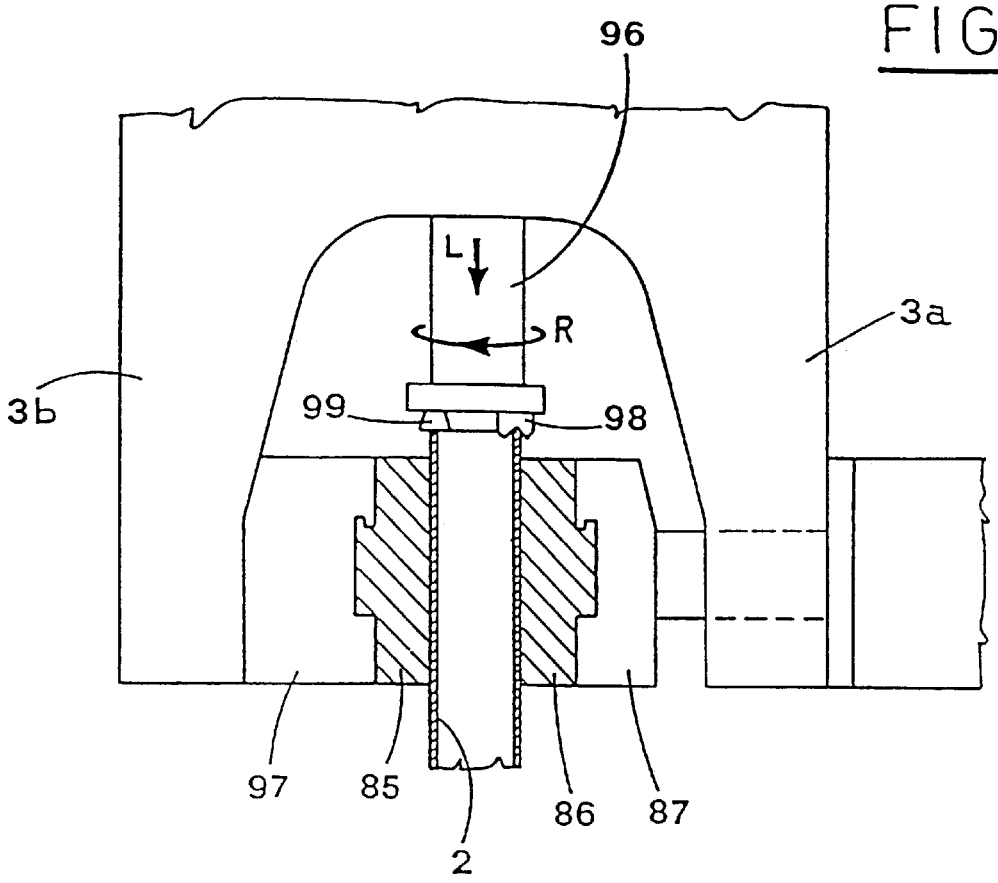
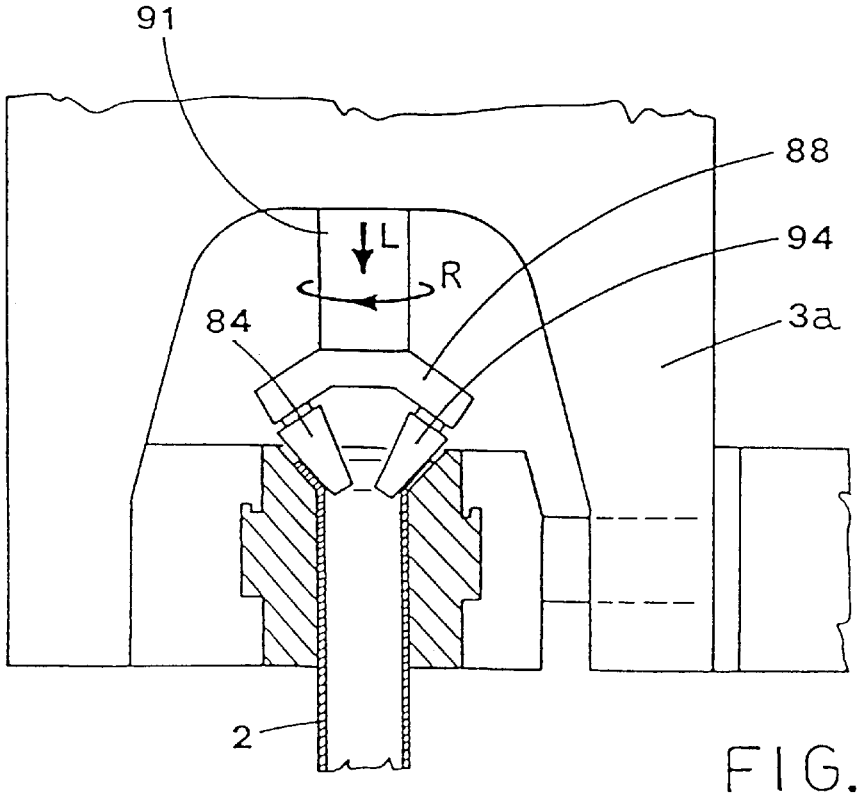
FIG. 15

MULTIPURPOSE HEAD FORMING AND FINISHING APPARATUS

TECHNICAL FIELD

The present invention relates to metallic pipe head forming and finishing operations, and concerns a multipurpose head forming and finishing apparatus.

BACKGROUND ART

Currently, many so-called head forming and finishing apparatuses are known that carry out flaring, widening, narrowing and other similar head forming and finishing or modifying operations on the heads of pipes.

These head forming and finishing apparatuses basically include a clamp for grabbing the pipe near the head thereof to be worked, and means for driving of a punch tool, mobile in a direction axial to the pipe held by the clamp.

The clamp includes a stationary jaw, supported by the apparatus base, and a mobile jaw moved vertically in such a manner as to be closed on the stationary jaw; the mobile jaw is fastened to a cross-piece displaced, via a couple of lateral vertical connecting rods, by an oil-pressure operated cylinder situated under the working surface.

The traditional head forming and finishing apparatuses have a very bulky structure and are little functional, particularly as the resistance to the stresses is concerned.

In fact, these apparatuses are equipped with very big motors, have long working cycles, with a remarkable energy consumption, and their tool set-up time is long, as well.

Document U.S. Pat. No. 3,411,338 discloses a tube flaring apparatus comprising a support flame and a clamp, operated in a horizontal direction suitable for gripping a pipe in proximity of a head to be worked. The clamp comprises a stationary jaw and a mobile jaw, suitable for operating a tool along a direction axial with respect to the pipe.

The above apparatus suffers for some drawbacks: the support frame is made of several members, which are fixed together by screws, and which have to be made by separate castings; one more tool supporting member is fixed separately from the support frame, and has to be precisely setup. Moreover, the tube head is gripped by the clamp jaws by means of a two-component female die, which is screwed to said jaws. Finally, the tool area and the clamp jaws area not easily accessible and visually controllable by an operator. This makes the apparatus settings quite long and complex.

DISCLOSURE OF THE INVENTION

The object of the present invention is to propose a multipurpose head forming and finishing apparatus, that is capable of performing an elevated number of operations, has small dimensions, features high resistance to stresses and is very functional.

The above mentioned object is achieved, in accordance with the claims, by means of a multipurpose head forming and finishing apparatus, that includes:

- a support frame forming on a horizontal plane a kind of arc endowed with a pair of arms symmetrical with respect to a median vertical plane;
- a clamp, operated in a horizontal direction, for gripping a pipe in proximity of a head to be worked, and including a stationary jaw and a mobile jaw, connected respectively to said arms of the support frame and aimed at being closed on said plane of median symmetry;
- means for operating a tool along a direction axial with respect to said pipe gripped by said clamp.

BRIEF DESCRIPTION OF THE DRAWINGS

The characteristics of the invention will be better understood from the following description, with particular reference to the attached drawings, in which:

FIGS. 11, 12 and 13 show respectively a side, front and plan view of a different embodiment of the support carriage of the apparatus;

FIGS. 14, 15, 16 and 17 plan views of the apparatus equipped with other particular head forming and finishing tools, with some parts cross-sectioned.

BEST MODE OF CARRYING OUT THE INVENTION

Figure 2:
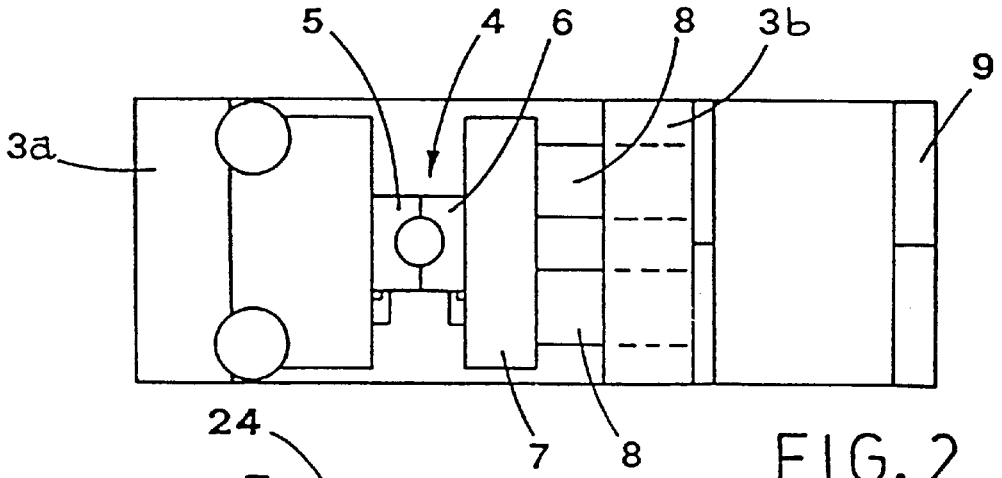
FIG. 2 shows a corresponding front view of the apparatus.

With reference to the aforesaid Figures, numeral 1 generally indicates the head forming and finishing apparatus that performs forming and finishing operations on the heads of a pipe 2.

The apparatus 1 includes a support frame 3 featuring a kind of arc that extends on a horizontal plane; in particular, this frame defines a couple of arms 3*a*,3*b* symmetrical with respect to a median vertical plane. The same frame 3 thus appears as an open-top, open-bottom frame.

The jaws of a clamp 4, aimed at gripping the pipe 2 in proximity of the head to work, are fastened to the arms 3*a*, 3*b* of the support frame 3.

The clamp 4 is operated according to a horizontal direction, in such a manner as to close the jaws on a plane coincident with the said median vertical symmetry plane.

More precisely, a stationary jaw 5 of the clamp 4 is rigidly fastened to the first arm 3*a* of the support frame; while a mobile facing jaw 6 is guided slidingly on the second arm 3*b* according to a horizontal direction transversal to the aforesaid median symmetry plane.

In fact, the mobile jaw 6 is fastened to a plate 7 fixed to the free extremity of a couple of stems 8 that are slidably guided through the arm 3*b* of the support frame 3 and are operated by a double action actuating member 9, for instance an pressure operated type device, integral with the same arm 3*b*.

Figure 4:
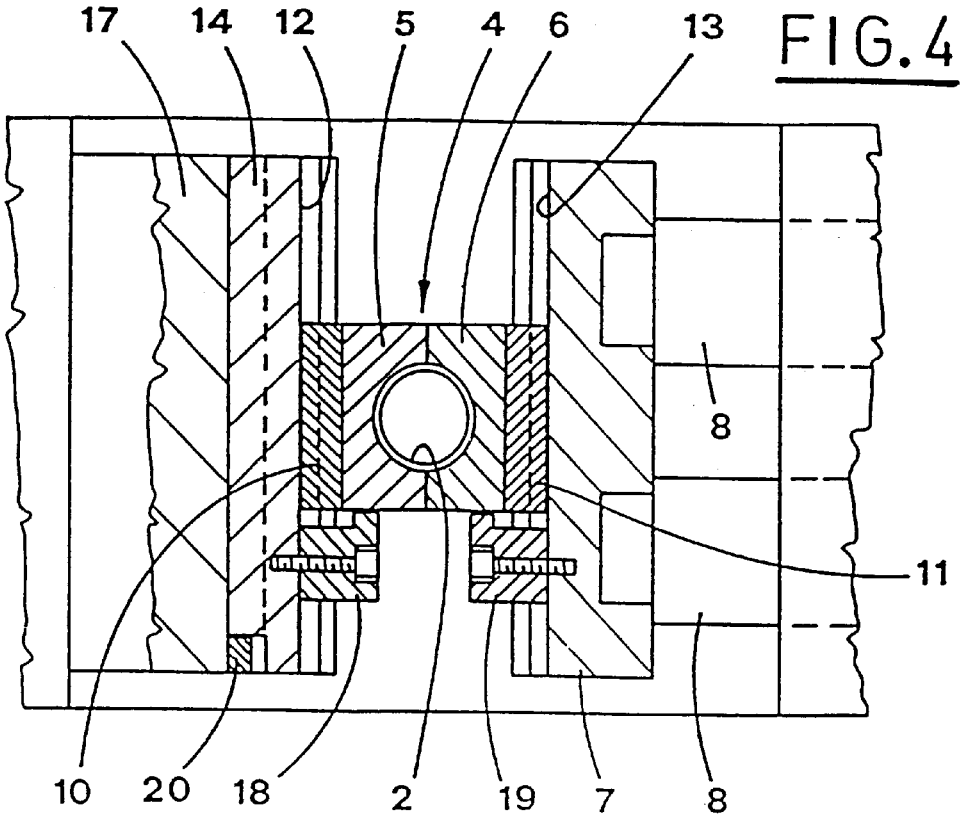
FIG. 4 shows a corresponding sectional view of the apparatus taken along a vertical transversal plane.
Figure 3:
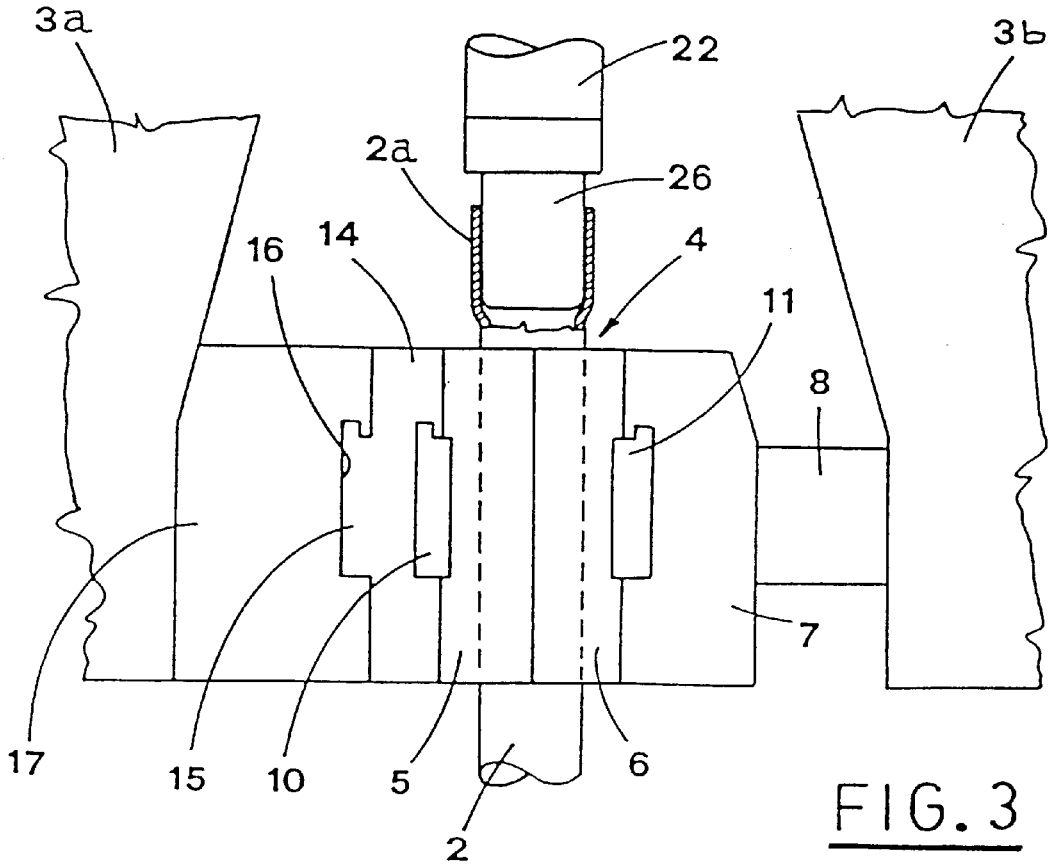
FIG. 3 shows a detailed plan view of the operation zone of the apparatus.

Respective prismatic means 10,11, are fixed to the jaws 5, 6 of the clamp 4, and are set in sliding engagement with respective vertical prismatic guides 12,13, which have a shape matching therewith machined in a spacing plate 14 and in the said plate 7 (see FIGS. 3 and 4).

The spacing plate 14 features a prismatic slide 15, similar to the previous ones, for engagement of a corresponding vertical guide 16, made on another plate 17 protruding from the arm 3*a* of the support frame 3.

Respective stop members 18,19, which define vertical positions of the jaws 5,6 of the clamp 4, are also fastened to the plates 14 and 7 by means of traditional screws, in the region of the guides 12,13, (FIG. 4).

Instead, the spacing plate 14 is brought in abutment onto a stop 20 fixed to the plate 17. The spacing plate 14 can be removed in order to work pipes of bigger diameter, that need a clamp equipped with jaws of bigger dimensions.

Obviously, in this case, the stationary jaw 5 engages directly the guide 16 of the plate 17.

An actuating means 21, also made integral with the support frame 3, operates a tool that performs the head forming and finishing operations. This tool is located on the said median plane and along a direction axial with respect to the pipe 2 gripped by the clamp 4.

This actuating means 21 is substantially constituted by an oil-pressure operated cylinder provided with a stem 22, mobile according to the aforesaid axial direction.

The fore and rear stop positions of the stem 22, are defined by a couple of proximity sensors 23,24, mounted in adjustable position along a bar 25 that extends from the support frame 3.

The head forming and finishing tool is, for instance a punch 26 fixed, by means of a quick coupling, to the front end of the stem 22.

Therefore, operating the active stroke of the stem 22 causes the axial penetration of the punch 26 in the pipe 2 gripped by the clamp 4, provoking the widening of the head 2*a*, as seen in FIG. 3.

Figure 1:
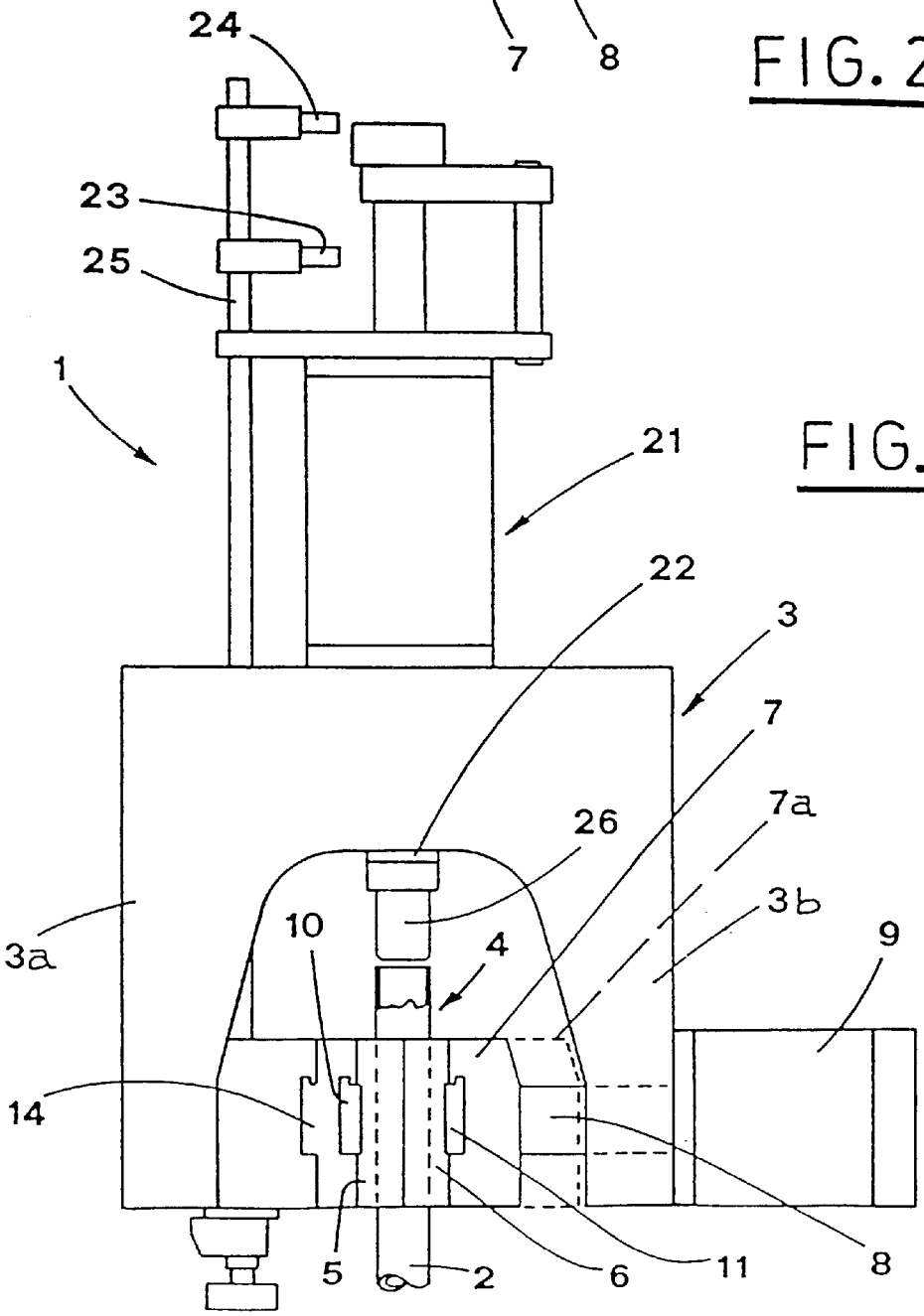
FIG. 1 shows a schematic plan view of the subject head forming and finishing apparatus.

In order to mount the pipe 2 on the head forming and finishing apparatus, first the clamp 4 is opened, by moving the plate 7 that carries the mobile jaw 6, as indicated with the broken line 7*a* in FIG. 1. This allows insertion of the pipe 2, and then the mobile jaw 6 is closed onto the stationary jaw 5 and the pipe 2 is gripped therebeteween.

The clamp 4, operated horizontally, holds the pipe 2 in a perfect symmetry in the support frame 3, that guarantees optimal conditions of stress resistance. Therefore the clamp 4 can, in closing step, support considerable stresses, up to the limit of elastic deformation of the pipe to work.

It is to be noted that if the frame becomes deformed because of the said symmetry, the pipe would anyway kept coaxial with the stem 22 carrying the tool.

Therefore, the constant quality of the pipes worked in this way is guaranteed. The horizontally operated clamp 4 allows the internal zone of the jaws to be easily seen in the opening step, for a better positioning of the pipe to work.

The apparatus allows to perform an elevated number of operations, due to possibility of easy substitution of the tools on the stem 22 of the operating means 21.

Besides tools working in compression, such as the illustrated punch 26, the apparatus can also use tools working in traction.

It is also possible to use particular tools equipped with dies that can be mounted on the support frame of the apparatus.

Figure 5:
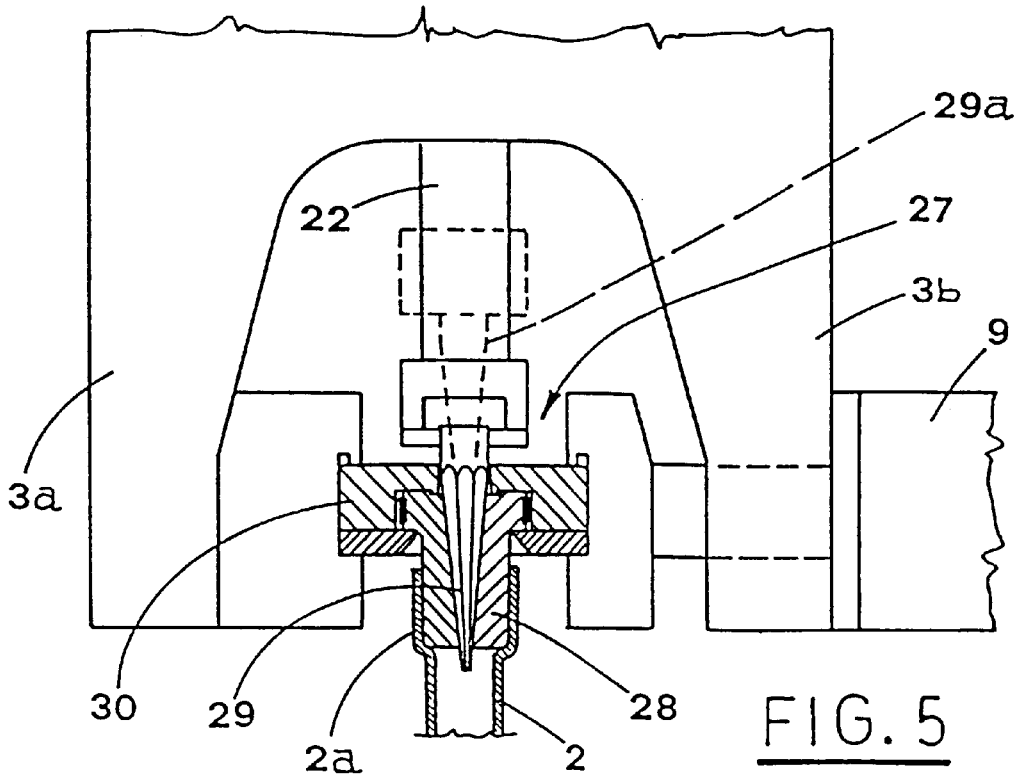
FIGS. 5 and 6 show plan views of the apparatus equipped with particular head forming and finishing tools, with some parts cross-sectioned.

FIG. 5, for instance, shows an expanding tool, indicated generally with numeral 27, aimed at widening the head of the pipe 2. This expanding tool 27 features, in known way, a series of radial sectors 28 mounted in a circle around a wedge 29, and held in place by a support 30 that is connected with the guides 12,13 of the support frame 3, instead of the jaws of the clamp 4 illustrated previously.

The wedge 29 is fixed coaxially to the stem 22 and operated thereby, in such a manner as to be retracted with respect to the support 30, as illustrated with broken line 29*a*.

In this configuration, the radial sectors 28 are near to each other, due to the action of suitable elastic means, therefore it is possible to introduce therein the pipe 2 to be worked.

The following active stroke of the stem 22, i.e. the stroke of penetration of the wedge 29, determines the forced expansion of the radial sectors 28 and widening of the head 2*a* of the pipe.

Figure 6:
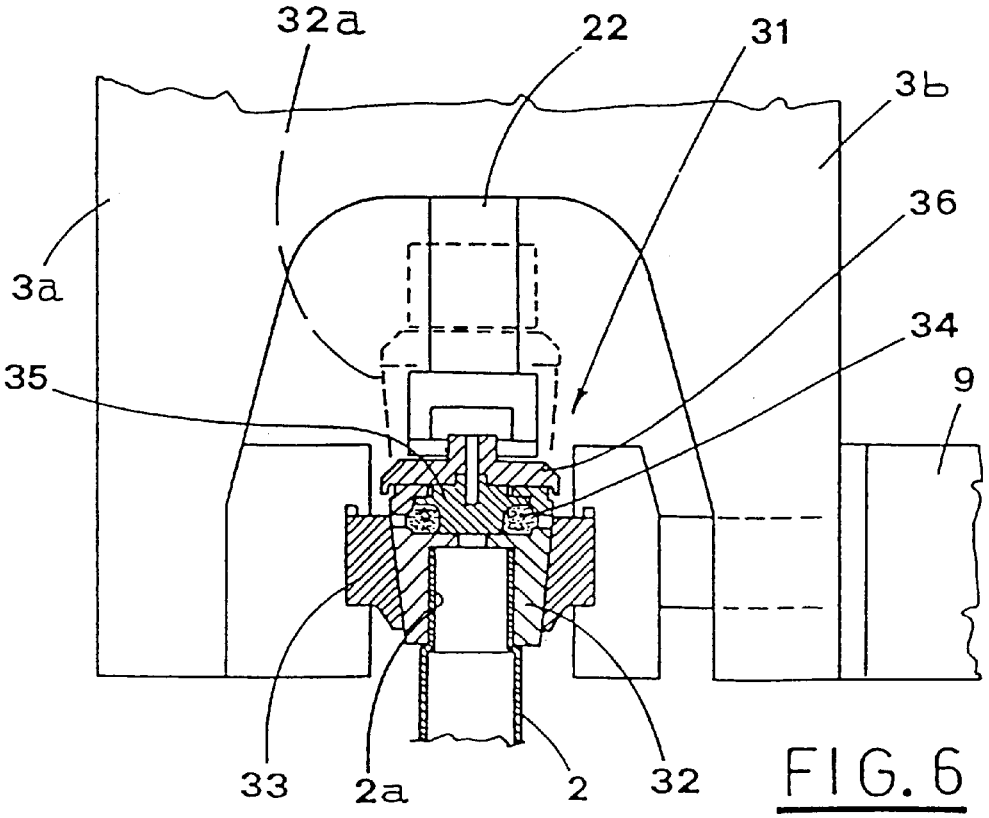

FIG. 6 shows a narrowing tool, indicated generally with 31, aimed at narrowing of the head 2*a* of the pipe 2.

This narrowing tool 31 features, in known manner, a series of radial sectors 32, externally forming a wedge, mounted in a circle inside a ring-like support 33 complementary thereto; the support 33 is connected to the guides 12, 13 of the support frame 3, instead of the jaws of the clamp 4.

The radial sectors 32 are made to expand by an elastic means 34 mounted on a disk-like plate 35 that is fixed to a flange 36 designed for connection to the stem 22.

Therefore, the radial sectors 32 can be retracted from the ring-like support 33, as indicated with broken line 32*a*, hence it is possible to introduce the pipe 2 to be worked.

The following active stroke of the stem 22 pushes the radial sectors 32 closer to each other and the consequently makes the head 2*a* of the pipe narrow.

With reference to FIG. 14, a head facing tool is connected to the stem 96 that, in this case, is also driven in axial rotation R by means of a known driving device, not shown.

The facing tool includes, in the shown embodiment, a flat cutting bit 99, and a cornering bit 98. The flat cutting bit faces the head of the pipe 2 gripped between the jaws 85,86 fixed to the plates 87,97, while the stem 96 is also pushed in direction L.

The cornering bit cuts the corners of the faced head.

In FIG. 15 there is shown a spin cone-shaping tool mounted on the stem 91, also turned axially in direction R. The spin cone-shaping tool includes a arc-shaped plate 88 whose ends support conical rollers 84,94 set with convergent axes. The intersection point of the conical rollers axes lays on the axis of the pipe 2.

When the stem is set into rotation R and pushed along direction L, the cone-shaping tool inserts into the head of the pipe 2, gripped by the clamp, and turn after turn it shapes the pipe head giving it a conical shape.

For better operation, the jaws are in this case shaped so as to match the cone being formed at the head of the pipe. For instance, the rim of the hole defined by the jaws ad facing the cone-shaping tool is countersunk.

Figure 16:
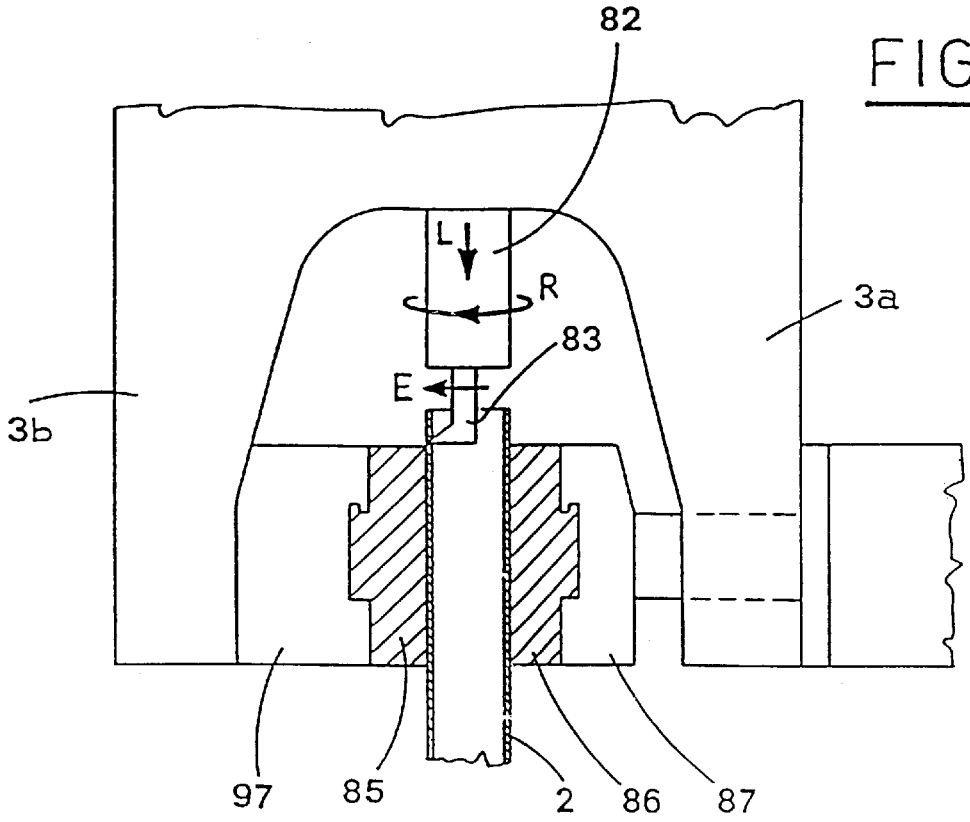

With reference to FIG. 16, the apparatus is in this case equipped with a spin cutting tool 83.

The stem 82 is rotated in direction R and displaced in direction L until it enters the head of the pipe 2, gripped by the jaws 85,86 fixed to the plates 87,97, until it reaches the point where the pipe is to be cut.

Then the stem 82 is imparted a transversal progressive motion in direction E so as to take an eccentric position with respect to the stem and pipe axes. Rotation of the stem will thus cut the pipe.

This gives a better appearance to the pipe head due to cutting from inside, while the circular shape is perfectly maintained by the grip action of the clamp.

Figure 17:
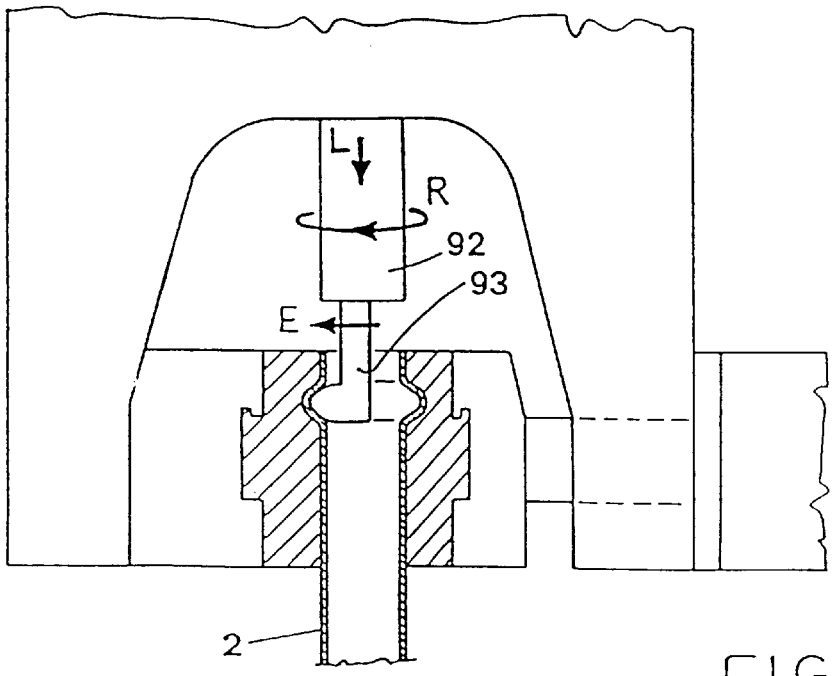

Another embodiment is shown in FIG. 17, where the shaping tool 93 is similar to the one of FIG. 16, but instead of cutting it makes a circular groove in the inner surface of the pipe.

For this operation the tool 93 has a curved profile and the jaws feature a circular groove that matches the tool profile.

After that the pipe 2 has been gripped by the clamp, the shaping tool is positioned in alignment with the groove made in the jaws by displacement of the stem 92 along direction L.

Then the stem is rotated in direction R and set eccentric by displacement thereof in direction E, until the groove is made in the pipe.

To improve the operation, a spacing element, not shown for clarity, can be positioned between the rim of the pipe 2 and the shank of the shaping tool 93.

Figures 7, 8:
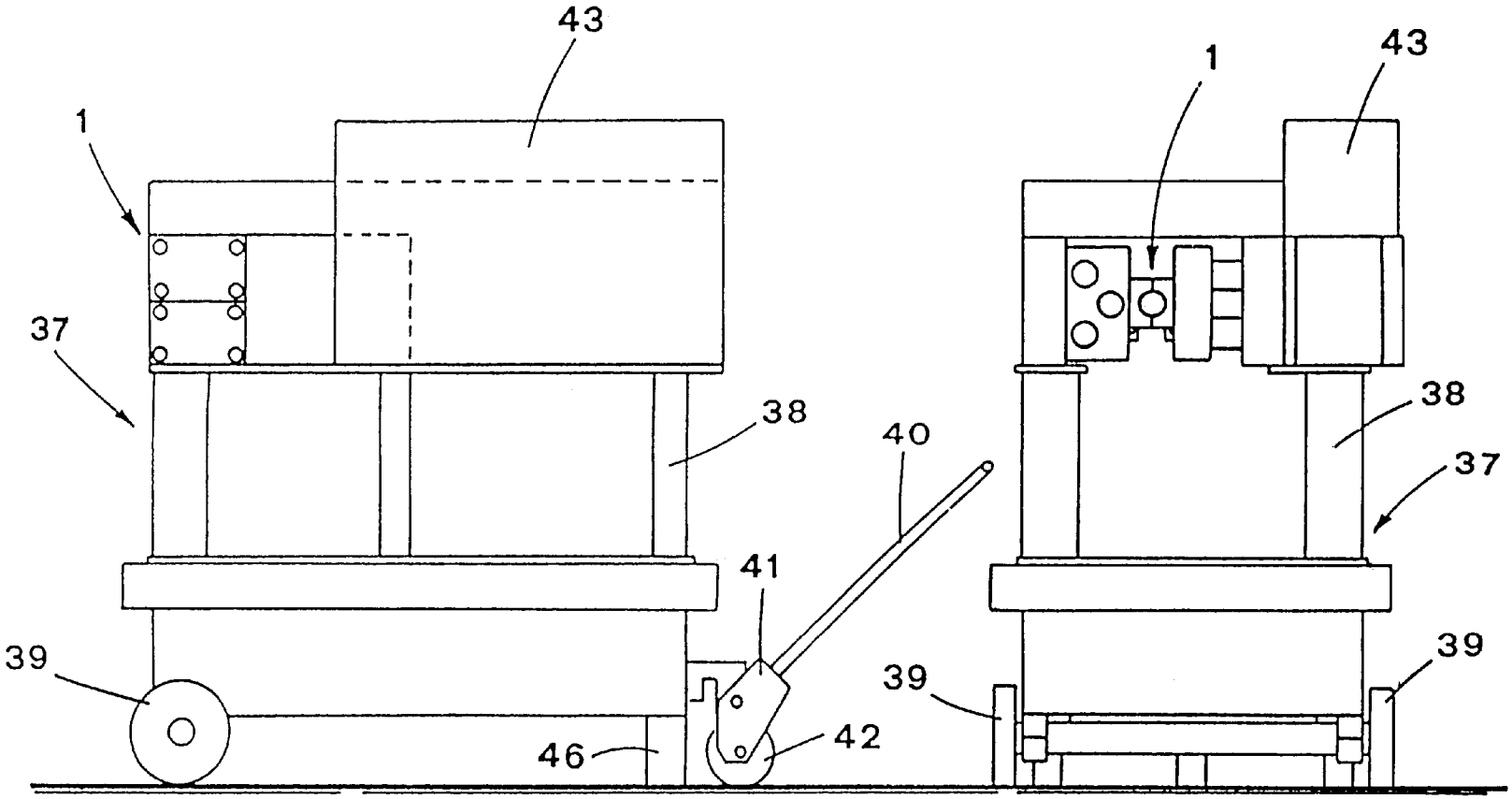
FIGS. 7 and 8 show respectively a side and front view of a support carriage of the subject apparatus.

The head forming and finishing apparatus 1 is suitably mounted on a carriage 37, designed to allow an easy transport thereof, as shown in FIGS. 7 and 8.

This carriage 37 basically includes a support structure 38 equipped with a couple of fore wheels 39 and, at the back, with a towing or rudder means 40, that supports a central pivoting wheel 42 by means of a fork 41.

The back wheel 42 and the rudder 40 form a lever mechanism, designed to lift the carriage 37 from the support on the feet 46, loading the weight on the same wheel 42.

When the rudder 40 is not pushed downwards, the weight returns onto the feet 46, and consequently, the structure 38 has firm support.

The structure 38 usefully supports an oil-pressure control unit 43 for supplying oil under pressure to the apparatus and making it completely autonomous.

If the head forming and finishing apparatus 1 is not equipped with an autonomous oil-pressure control unit, it is obviously provided with conventional quick connection means for connection to external feeding means.

Figures 9, 10:
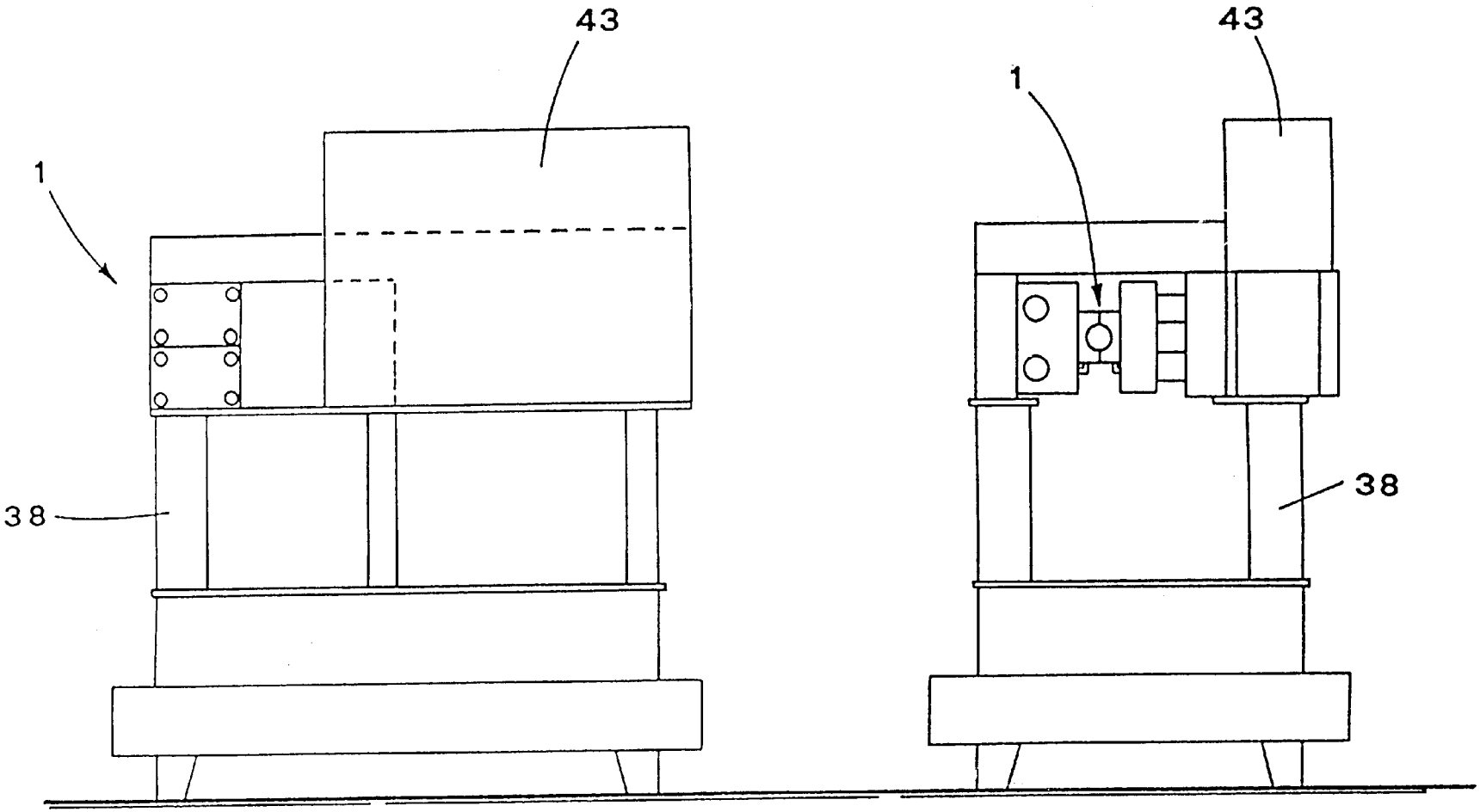
FIGS. 9 and 10 show corresponding views of a stationary frame of the apparatus support.

Naturally, it is possible to use the said structure 38 as fixed support for the apparatus 1, in particular if it is provided with the oil-pressure control unit 43, as shown in FIGS. 9 and 10.

FIGS. 11, 12 and 13 show an innovative embodiment of the support carriage 37 of the head forming and finishing apparatus 1, in which the structure is made of modular elements 44 constituted by tubular elements with circular section, suitably folded up; these tubular elements 44 are rigidly fastened by means of brackets 45.

A similar tubular element, fastened by means of the aforesaid bracket 45, carries the fore wheels 39.

Obviously, also in this case the carriage 37 can support the oil-pressure control unit 43 for feeding of the apparatus.

Therefore, the object apparatus resolves in an innovative manner the problem of a precise forming and/or finishing of the head of pipes, having a simplified solid structure, reduced dimensions, and being easy to use.

The apparatus allows to perform an elevated number of operations, and in practice can have a universal use with the known tools.

It is understood that what above has been described as a pure example, non limitative, therefore all possible constructive variations remain under protection of the present technical solution, as described above and claimed hereinafter.

I claim:

1. A multipurpose head forming and finishing apparatus, comprising:

a support frame;

a clamp fastened to said support frame and operated in a horizontal direction for gripping a pipe in proximity of a head to be worked, said clamp having a stationary jaw and a mobile jaw;

a pair of arms protruding from said support frame to form substantially an arc on a horizontal plane, providing an open-top and an open-bottom support frame, said arms being symmetrical with respect to a median vertical plane, said stationary jaw and said mobile jaw of said clamp being connected respectively to said arms of the support frame and being fit to be closed on said median symmetry plane;

a tool for acting on the head of the pipe;

actuating means for directing the tool along a direction axial with respect to said pipe gripped by said clamp;

coupling means fixed to the stationary jaw and the mobile jaw of the clamp and fastened to said arms of said support frame, so that said jaws can be slidably removed from said arms and changed.

2. The apparatus according to the claim 1, wherein said coupling means include prismatic members fixed to the jaws of the clamp and respective vertical prismatic guides having a shape for receiving said prismatic members in said arms.

3. The apparatus according to claim 2, further comprising removable spacer plates, located between said arms and said jaws, each plate having an integral prismatic slide for engaging a corresponding vertical guide made on said arm of said support frame, each plate having a vertical prismatic guide for receiving said prismatic members in said plates.

4. The apparatus according to claim 1, wherein said support frame has a first arm for carrying said stationary jaw and a second arm having plate means for carrying said mobile jaw, a jaw actuator made integral with the second arm for displacing the plate means.

5. The apparatus according to claim 1, wherein said tool is a punch fixed to a front end of a stem of the actuating means for causing axial penetration of said punch into said pipe for widening of the head thereof.

6. The apparatus according to claim 1, wherein said tool is a head facing tool connected to a stem of the actuating means that further drives said stem in axial rotation, said head facing tool including a flat cutting bit that faces the head of said pipe, and a cornering bit that cuts corners of the faced pipe head.

7. The apparatus according to claim 1, wherein said tool is a spin cone-shaping tool connected to a stem of the actuating means that further drives said stem in axial rotation, said spin cone-shaping tool including an arc-shaped plate whose ends support conical rollers set with convergent axes for giving the head of said pipe a conical shape.

8. The apparatus according to claim 7, wherein said jaws are shaped to match the cone being formed at the head of the pipe.

9. The apparatus according to claim 1, wherein said tool is a spin cutting tool connected to a stem of the actuating means that further drives said stem in axial rotation, the tool being transversely displaced to set the spin cutting tool eccentric with respect to said pipe for cutting the head of said pipe.

10. The apparatus according to claim 1, wherein said tool is a spin shaping tool with a curved profile connected to a stem of the actuating means that further drives said stem in axial rotation, the tool being transversely displaced to set the spin shaping tool eccentric with respect to said pipe for shaping a circular groove in an inner surface of said pipe.

11. The apparatus according to claim 10, wherein said jaws have a circular groove with a profile for receiving the circular groove in the inner surface of the pipe.

12. The apparatus according to claim 1, further comprising a carriage for carrying the apparatus, the carriage including a support structure equipped with a couple of fore wheels and, at the back, with feet, the support structure being lifted by a lever mechanism pivoting on a steering wheel, said support structure supporting an oil-pressure feeding control unit.

13. A multipurpose head forming and finishing apparatus, comprising:

a support frame;

a mobile support and a stationary support fastened to said support frame and operated in a horizontal direction, said mobile support supporting a first part of a tool for carrying out forming operations on a head of a pipe, a pair of arms protruding from said support frame so as to form a substantial arc on a horizontal plane, said arms being symmetrical with respect to a median vertical plane, thus giving the support frame an open-top and an open-bottom, said stationary support and said mobile support of said clamp being connected respectively to said arms of the support frame and being fit to be closed on said median symmetry plane;

actuating means for moving a second part of said tool along a direction axial with respect to said first part; and, coupling means fixed to the stationary support and the mobile support and engaged to said arms of said support frame, so that said stationary support and said movable support can be slidably removed from said arms and changed.

14. The apparatus according to claim 13, wherein said first part of said tool includes a series of radial sectors mounted in a circle and held in place by the stationary support and the mobile support that are coupled to said arms, said second part of said tool including a wedge that is fixed coaxially to a stem of the actuating means, said wedge being moved axially so as to expand said radial sectors, thus enlarging a head of a pipe surrounding a terminal part of said radial sectors.

15. The apparatus according to claim 13, wherein said first part of said tool includes a series of radial sectors, forming a wedge externally of the pipe and mountable in a circle inside a ring-like support complementary thereto formed by the stationary support and the mobile support that are coupled to said arms, said second part of said tool includes a disk-like plate that is fixed to a flange connected to a stem of the actuating means, said flange and disk-like plate being moved axially in a first direction so as to expand said radial sectors for insertion of a head of a pipe among terminal parts of said radial sectors, and in a second direction for pushing the radial sections closer to each other, due to a wedging action of said ring-like support, to make said head narrower.

16. The apparatus according to claim 13, further comprising a carriage for carrying the apparatus, the carriage including a support structure equipped with a couple of fore wheels and, at the back, with feet, the structure being lifted by a lever mechanism pivoting on a steering wheel, said structure supporting an oil-pressure feeding control unit.

* * * * *